US007032273B2

(12) United States Patent
Pinto

(10) Patent No.: US 7,032,273 B2
(45) Date of Patent: Apr. 25, 2006

(54) FIBER MIXING AND OPENING MACHINE

(76) Inventor: Akiva Pinto, 504 E. 63rd St., New York, NY (US) 10021

( * ) Notice: Subject to any disclaimer, the term of this patent is extended or adjusted under 35 U.S.C. 154(b) by 437 days.

(21) Appl. No.: 10/436,226

(22) Filed: May 12, 2003

(65) Prior Publication Data

US 2004/0226144 A1 Nov. 18, 2004

(51) Int. Cl.
*D01G 13/00* (2006.01)

(52) U.S. Cl. ..... 19/145.5

(58) Field of Classification Search ..... 19/105, 19/200, 202–205, 97.5, 65 A, 145.5, 296, 19/303, 304; 8/151.1, 151.2, 155, 156, 115.51, 8/115.7

See application file for complete search history.

(56) References Cited

U.S. PATENT DOCUMENTS

| | | | | |
|---|---|---|---|---|
| 2,703,438 | A * | 3/1955 | Greene et al. | 177/69 |
| 2,885,741 | A * | 5/1959 | Leineweber | 19/145.5 |
| 3,010,161 | A * | 11/1961 | Duvall | 264/116 |
| 3,149,065 | A * | 9/1964 | Doorn | 209/3 |
| 3,717,904 | A * | 2/1973 | Bonner et al. | 19/66 R |
| 3,829,934 | A | 8/1974 | Neu | 19/202 |
| 3,889,319 | A * | 6/1975 | Roberson | 19/145.5 |
| 4,240,180 | A | 12/1980 | Wood et al. | 19/105 |
| 4,797,979 | A * | 1/1989 | Staheli et al. | 19/105 |
| 4,858,278 | A | 8/1989 | Pinto et al. | 19/200 |
| 5,018,245 | A | 5/1991 | Marzoli et al. | 19/145.5 |
| 5,522,119 | A | 6/1996 | Leifeld et al. | 19/106 |
| 5,655,262 | A | 8/1997 | Sterin et al. | 19/200 |
| 6,276,028 | B1 * | 8/2001 | Pinto | 19/105 |
| 6,615,455 | B1 * | 9/2003 | Pinto | 19/105 |

* cited by examiner

*Primary Examiner*—Gary L. Welch
(74) *Attorney, Agent, or Firm*—McNair Law Firm, P.A.

(57) ABSTRACT

A fiber blending, opening and cleaning arrangement which includes a feed section for delivering a blend of fibers onto a first opening and blending operation, comprising an array of parallel opening and blending rolls rotating in one direction and arranged along an incline and in adjacent positions. The fibers are passed over the rolls in a first direction and under the rolls in a section direction while being also moved along a sinusoid path. Upon existing the array of rolls, the fibers fall into a fine opening and blending operation which fully mixes the fibers.

15 Claims, 4 Drawing Sheets

FIBER MIXING AND OPENING MACHINE

BACKGROUND OF THE INVENTION

The present invention is directed to an improved fiber opening and blending device.

In order to speed production of opening blending and cleaning fibers, a trend has developed in which the cording machine is eliminated from the process in lieu of the faster fiber batt forming machines. It has been found with the fiber batt process and especially in the case where fibers of different textures, sizes or colors are blended that complete and even blending does not always occur. Techniques such as lapping can correct this shortcoming yet here again, this method is expensive and time consuming.

It is therefore an object of this invention to provide opening and blending apparatus and system in which both high production and complete and thorough opening and blending is achieved.

Another object of the invention is a mixing machine which provides for fiber treatment during opening and mixing with liquid or solid material.

Another object of the invention is an opening and mixing apparatus which utilizes a zig zag fiber motion through the opening area.

Another object of the invention is the provision of teeth for use with opening rolls which create air currents which flow in a zig zag pattern through the openings and blending machine.

Another object of the invention is the provision of an opening and blending arrangement which includes a heavy duty blending section and a fine blending section.

Another object of the invention is the provision of an array of opening and blending rolls with interacting teeth which both physically engage the fibers to move along an sinusoidal path and also create an air flow which assists the fibers along this path.

SUMMARY OF THE INVENTION

The instant invention is directed to a fiber opening and blending arrangement for use in thoroughly mixing fibers for formation of fiber batts. The arrangement includes a plurality of fiber handling stations including a feed station, a blending and opening station and a fine blending and opening station.

The feed station may comprise a silo into which opened fibers are fed. The silo includes feed rolls which act to open, blend and feed the fibers onto an array of opening and blending rolls.

The feed station may comprise a plurality delivery belts arranged in association with compression rolls, mixing rolls and feed rolls which act to deliver fibers into the cabinet and onto top surfaces of the array of opening and blending rolls.

The array of opening and blending rolls are preferably arranged within a cabinet and along an incline. Each of the rolls rotates in the same direction. Each roll contains a plurality of parallel rows of teeth which act to both engage, open, blend and move the fibers through the cabinet but also to create an air flow within the cabinet.

The teeth are arranged in opposing positions between the rows. The positions along with the shape of the teeth cause the fibers and the air flow to move along a sinusoid path over the array of rolls.

The cabinet includes a chamber arranged over the array of rolls. The cabinet may also include feeds for the delivery of water, dye, and/or chemicals into the chamber for mixing with the fibers during the blending and opening operations.

The opening process within the cabinet carries the fibers first over and down the inclined array of opening and blending rolls. The fibers are fluffed or caused to tumble when passing through the chamber. As the fibers reach the end of the array of rolls, they are passed about the end opening and blending roll and then moved over the lower surface of each roll of the array of rolls again moving along a sinusoid path. Upon reaching the exit, the fibers are discharged into a fine fiber mixing machine.

A first fine mixing arrangement may include a receiving belt arranged perpendicular of the opening and blending rolls of the array of rolls. A second receiving belt is arranged above the first receiving belt. The fiber exit includes a compression roll which discharges the fibers for further processing. A mixing roll engages the fibers in progress to the compression area.

A second fine mixing arrangement includes a pair of opening rolls, a main roll and an inner chamber as described in co-pending application Ser. No. 10/244,185 filed on Sep. 16, 2002, the disclosure of which is incorporated herewith.

DETAILED DESCRIPTION

Figure 1:
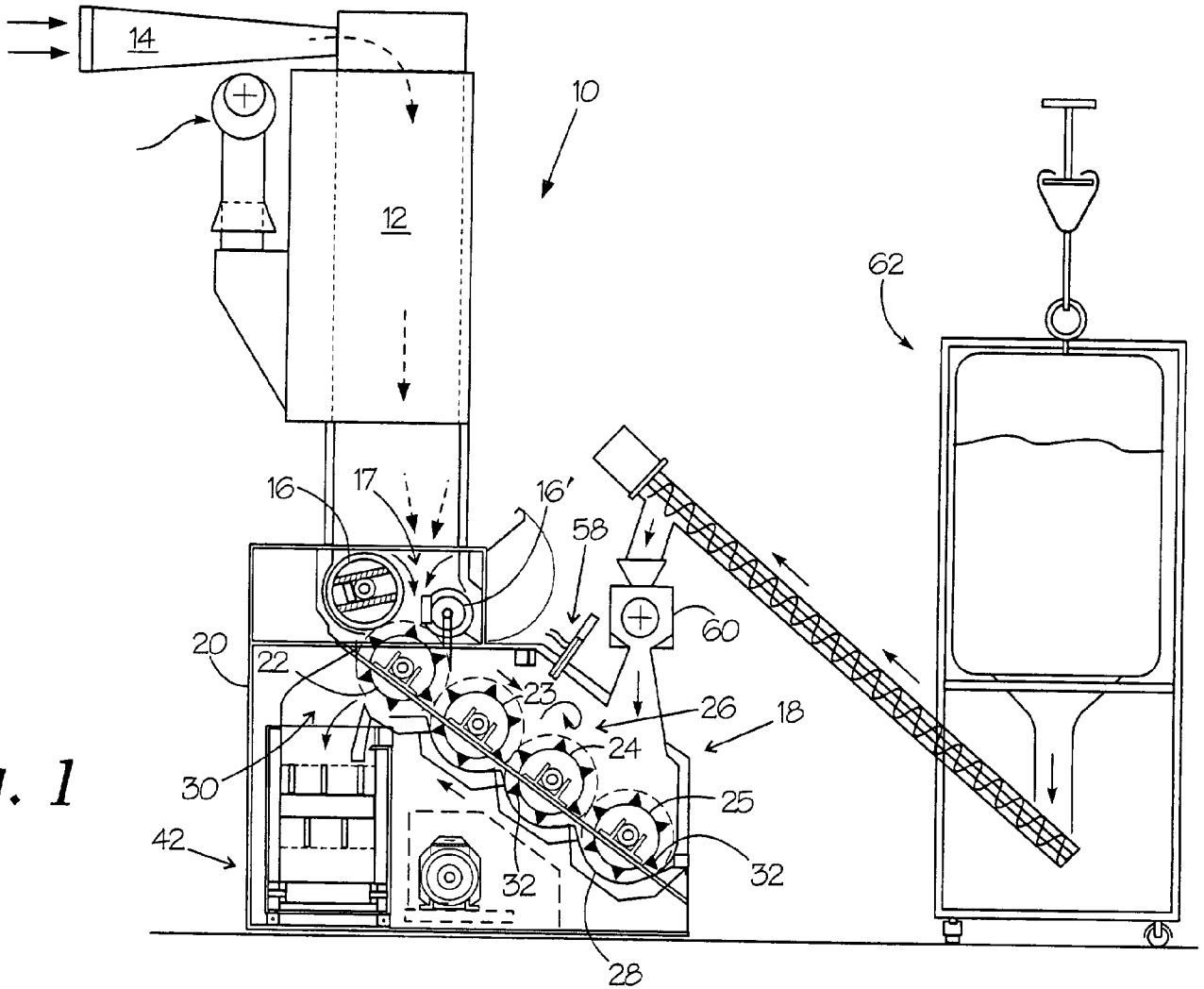
FIG. 1 is a cutaway side view of an arrangement for opening and blending fibers in accordance with the invention.

FIG. 1 shows a fiber opening, blending and cleaning arrangement 10 in accordance with the invention. The arrangement includes a silo 12 which receives opened fibers through delivery 14. Preferably the fibers delivered to the silo comprise a blend of fibers which may include fibers, different materials, different sizes, and/or different textures.

The fibers are moved through the lower end of the silo and into an inclined opening and blending unit 18 by feed rolls 16, 16[1].

Unit 18 comprises a cabinet 20 which houses an inclined array of four opening and blending rolls 22, 23, 24, 25. Rolls 22–24 are arranged adjacent and parallel each other and are driven in the same direction as indicated by the arrows. A chamber 26 is formed above rolls 22–25 while an under casing 28 is arranged adjacent lower surfaces of rolls 22–25.

Casing 28 encircles about ¼ the periphery of rolls 23, 24 slightly more of the periphery of roll 25 and slightly less of the periphery of roll 22. Casing 28 terminates at exit 30 which connects with a fine blending and opening apparatus.

Figure 5:
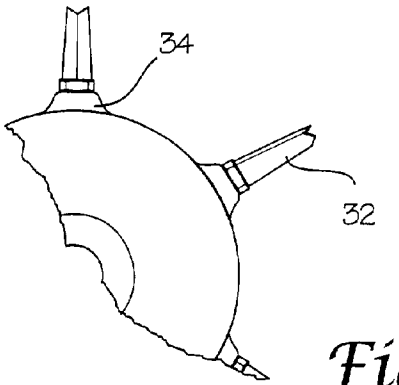
FIG. 5 is an enlarged side sectional view of an opening roll shown in FIG. 4*b*.
Figure 4B:
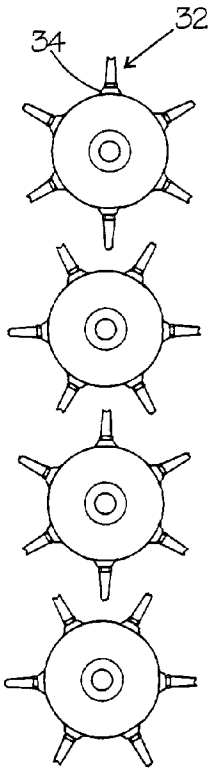
FIG. 4*b* is a side view of the opening rolls shown in FIG. 3.
Figure 4A:
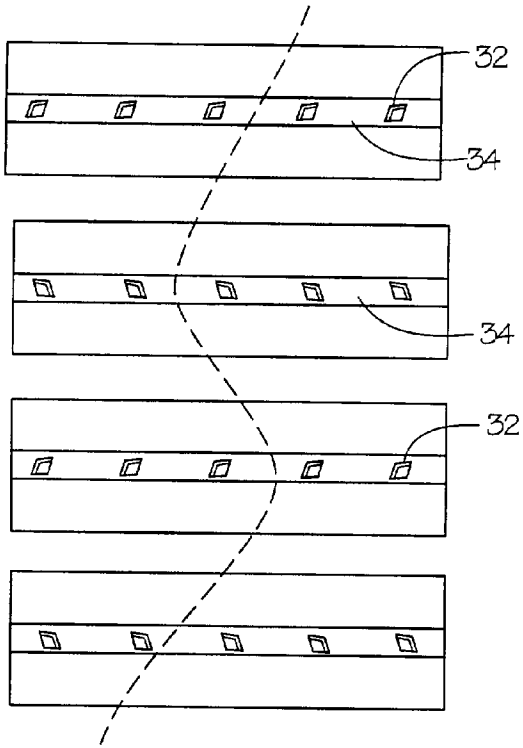
FIG. 4*a* is a top view of the opening rolls shown in FIGS. 1 and 3.

Teeth 32 are arranged in parallel and spaced rows about the periphery of each of rolls 22–25 as shown in FIGS. 4*a*, 4*b* and 5. Preferably there are six rows of teeth although the number could be less or more. Preferably each roll 22–25 is formed with a plurality of raised bars 34. Bars 34 assist in opening and blending the fibers and also in creating air current within the cabinet. Teeth 32 are mounted in spaced positions on top of each bar 34.

Figure 6:
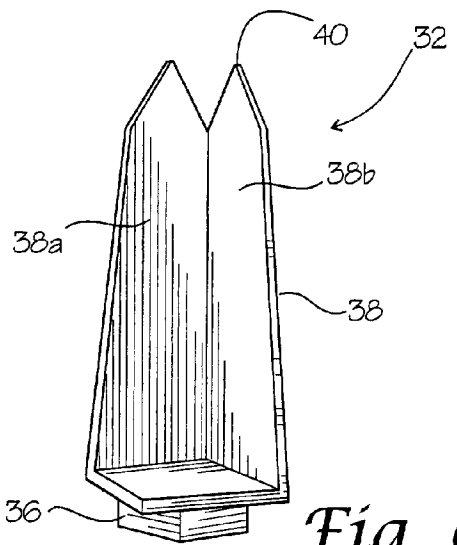
FIG. 6 is a perspective view of a tooth used with the opening and blending rolls shown in FIG. 4*a*.

Each tooth 32, as best shown in FIG. 6, includes a base 36 and a substantially L-shaped body 38. Body 38 comprises a pair of planar portions 38*a* and 38*b*. Each planar portion extends vertically from base 36 and are connected along one edge to extend at about a 60° angle to each other. A tip 40 is formed atop each planar section.

Teeth 32 are secured along bars 34 with one planar section 38*a*, 38*b* being perpendicular the axis of the bar and the other planar section 38*a*, 38*b* being at about 60° to the opposite planar section. The teeth are arranged in like manner along each row 34 and in alternating manner between rows 34.

Figure 2:
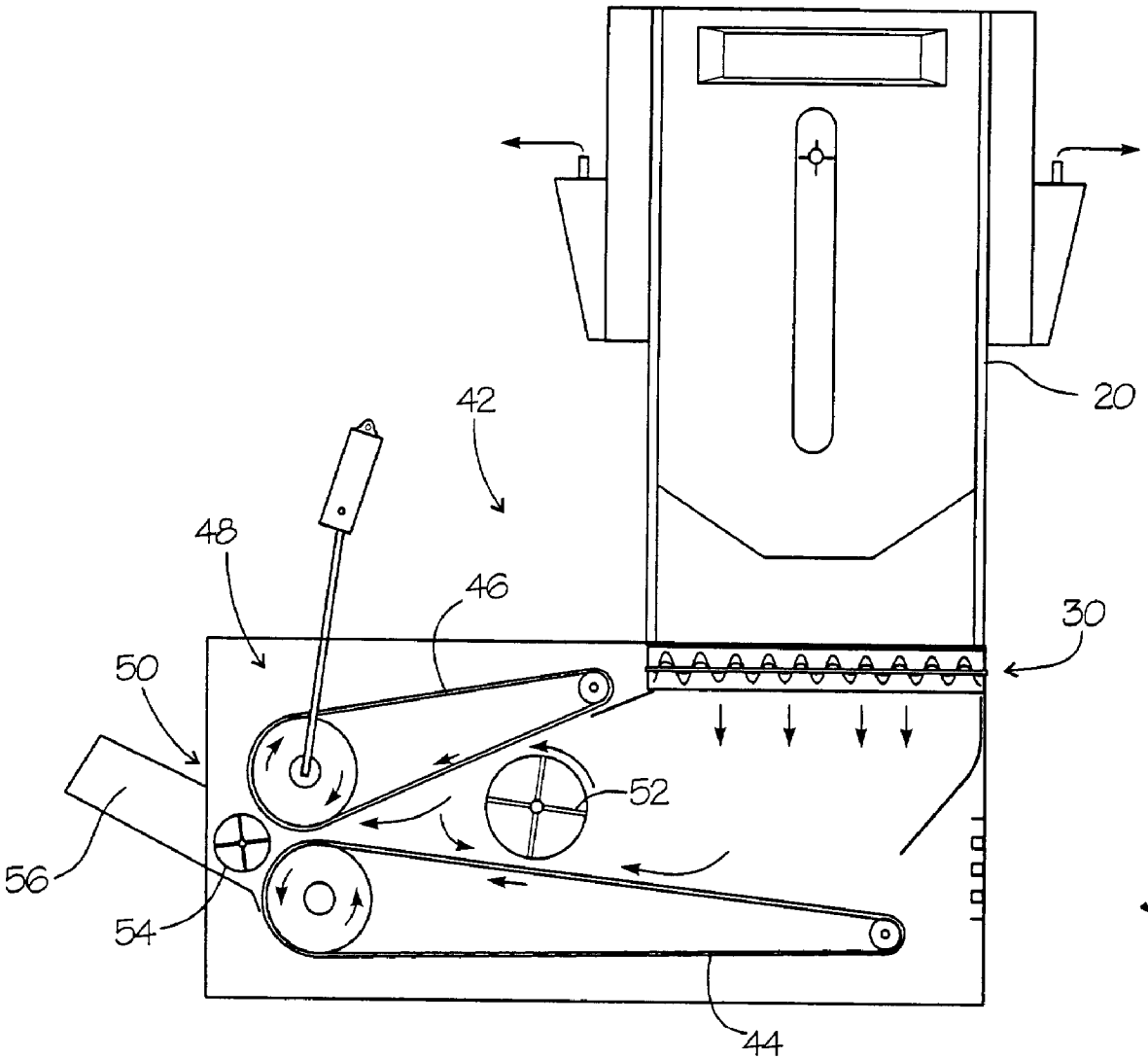
FIG. 2 is a sectional side view of a portion of the fiber blending and opening arrangement shown in FIG. 1.

Positioned beneath exit 30 is a fine mixing arrangement 42 which is best shown in FIG. 2. Mixing arrangement 42 includes a feed belt 44 arranged at 90° to the axis of roll 22. A compression belt 46 is arranged over feed belt 44 and includes a compression roll 48 at its delivery end 50. A mixing roll 52 is arranged across belt 44 and acts to blend and open the fibers delivered from exit 30. A mixing roll 54 receives the fibers from delivery 50 and feeds them into a pneumatic carrier 56.

Turning again to FIG. 1, there is seen a pair of deliveries 58 and 60. Delivery 58 may supply a water spray into chamber 26 for mixing with the fibers during opening and cleaning. Delivery 60 is designed to deliver chemicals and/or dye into chamber 26 during the opening and blending process to blend with the fibers. The chemicals and/or dye is compounded and delivered through known means as illustrated at 62.

In operation, fibers are delivered into silo 12 which in turn feeds them through feed 17 onto upper roll 22 of the array of opening and blending rolls 22–25. Teeth 32 engage the fibers opening, blending and moving them over to roll 23, which performs the same action moving the fibers onto roll 24. Simultaneous with this action fibers are fluffed or tumbled through chamber 26 further opening and blending them.

Due to the configuration of teeth 32 and their arrangement on rolls 22–25 air currents which move in a sinuoid or zig zag path are created as illustrated in FIG. 4*a*. The shape and arrangement of the teeth also when engaging the fibers force them to move first in one direction and then the other. These forces create a fiber movement which brings about enhanced opening and blending and also evenly distributes the fibers across the length of the rolls.

If desired and simultaneously with the operation water, dye and/or chemicals are emitted into chamber 26 to be blended with the fibers during this opening and blending operation.

Upon reaching roll 25, the fibers are carried around the roll to its lower surface where they are continued to be acted upon by the teeth and air currents as they are moved between the lower periphery of rolls 22–25 and casing 28 to exit 30.

The fibers pass through exit 30 into belt 44 of fine opener 42. Here they are again mixed by roll 52 as they pass through the compression exit 50 and into air transport 56.

Figure 3:
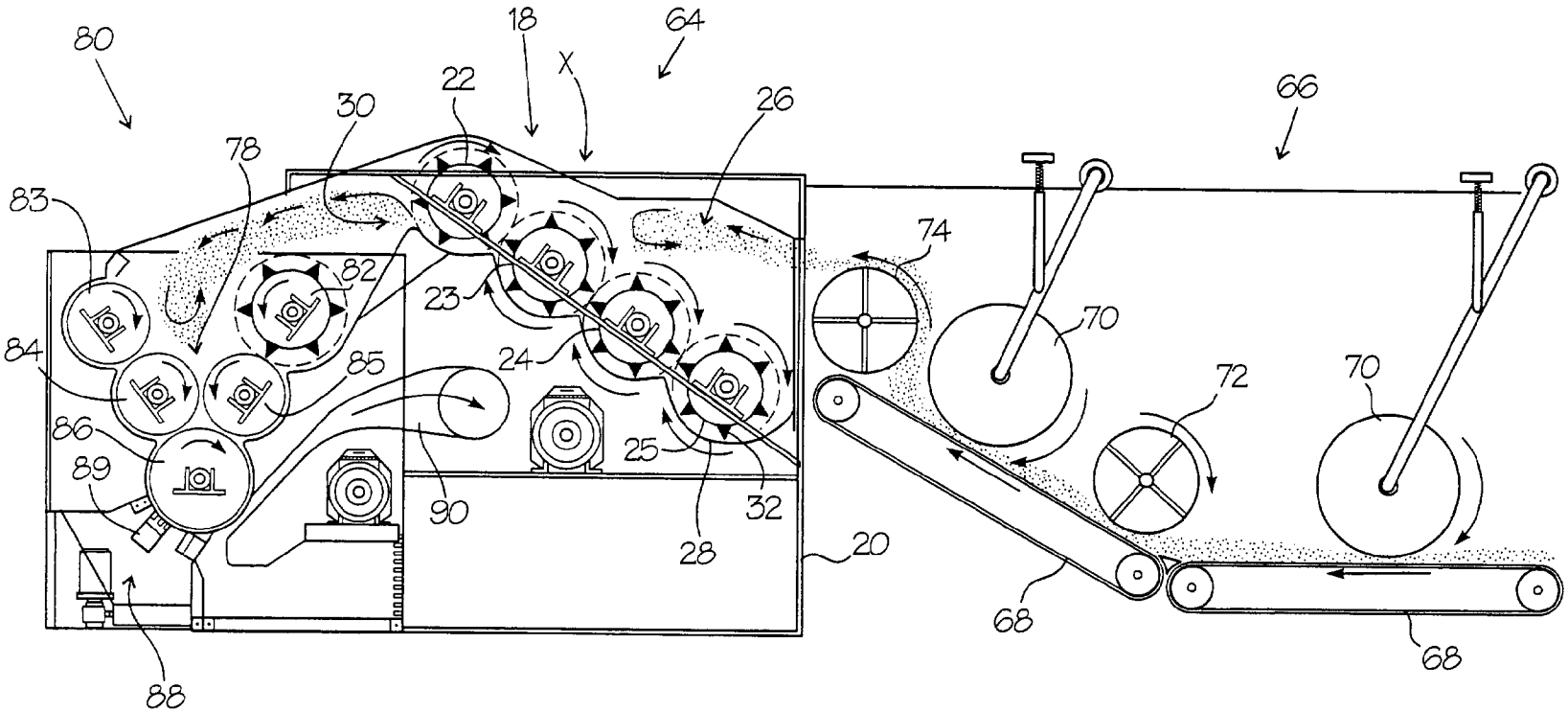
FIG. 3 is a cutaway side view of a second arrangement for opening and blending fibers in accordance with the invention.

The opening and blending arrangement is shown in a slightly different context in FIG. 3. Here the opening arrangement 64 includes a feed 66 which comprises a plurality of feed belts 68 which carry fibers from an opening and blending arrangement generally described in U.S. Pat. No. 3,889,319 to mixing and blending arrangement 18. The fibers may pass beneath compression rolls 70 and mixing rolls 72, 74. Roll 74 doffs the fibers from belt 68 and tosses them into chamber 26 of cabinet 20.

A feed indicated at x may be provided to deliver water, dye and/or chemicals into chamber 26 as earlier described.

Again, the fibers are acted upon by rolls 22–25 in the manner earlier described. Upon reaching exit 30 the fibers are deposited into inner chamber 78 of fine opening device 80. Fine opening device 80 includes an opening and blending doffer 82 constructed similarly to rolls 22–25, a doffing roll 83, a pair of opening rolls 84, 85, a main roll 86, mote knives 89, waste removal chamber 88, and doffing and removal duct 90.

The fibers delivered from roll 22 are thrown through exit 30 as shown by the arrow engaged by roll 82 or its resulting air currents and tumbled into inner chamber 78. Here they are continued in a tumbling motion and picked up by opening rolls 84, 85 or doffer 83 and moved through the various channels with continued opening, blending and cleaning to be finally removed through removal duct 90 for further processing. This arrangement is more fully described, both structurally and operationally, in more detail in co-pending application Ser. No. 10/224,185 filed on Sep. 16, 2002, the disclosure of which is incorporated herein.

The fibers processed by way of the above arrangements are more thoroughly blended throughout and produce more evenly distributed fibers within fiber batts subsequently formed.

What is claimed is:

1. A fiber blending and opening arrangement comprising;

an array of opening and blending rolls arranged in juxtaposed positions within a cabinet and driven in a first direction, each said roll including a plurality of spaced rows of shaded upstanding teeth;

an open chamber arranged over upper surfaces of said array of rolls and a closed casing arranged adjacent to and about at least lower portions of each said roll of said array of rolls;

a feed delivering opened fibers onto upper surfaces of said array of rolls for engagement with said teeth and an exit allowing said fibers to move from adjacent lower surfaces of said array of rolls;

said teeth being shaped and arranged at selected angles along said rows to create air currents which move along generally longitudinal paths in a sinusoidal manner within said cabinet; whereby;

said fibers passing from said feed are engaged and moved by said teeth and said air currents along said sinusoid and generally longitudinal paths first over upper surfaces of at least certain ones of said array of rolls and then beneath at least certain ones of said rolls causing extensive opening and blending of said fibers before moving through said exit.

2. The arrangement of claim 1 wherein said chamber allows fluffing of said fibers during passage over said rolls.

3. The arrangement of claim 1 including an additive delivery connected with said chamber, said delivery being capable of delivering at least one of water, dye, and chemicals for blending with said fibers.

4. The arrangement of claim 1 wherein said feed includes a silo for receiving opened fibers and feed rolls for delivering said fibers onto said array of rolls.

5. The arrangement of claim 1 wherein said teeth are secured along spaced parallel rows with said rolls.

6. The arrangement of claim 1 wherein said teeth include a substantially shaped vertical extension.

7. The arrangement of claim 1 wherein said exit delivers said fibers onto a fine blending and opening apparatus which includes an inner chamber having a pair of parallel and horizontally aligned opening rolls arranged above a main roll, said fine blending apparatus further opening and blending said fibers.

8. The arrangement of claim 1 wherein said feed includes a feed belt adjacent said open chamber and a mixing feed roll, said mixing feed roll engaging fibers delivered on said feed belt and projecting them into said open chamber and onto upper surfaces of said rolls of said array of rolls.

9. The arrangement of claim 8 wherein said feed includes at least a second feed belt and a compression roll cooperating with said feed belts.

10. The arrangement of claim 1 wherein said exit connects with a fine mixer which includes a feed belt arranged transverse said rolls of said array of rolls, said belt receiving said mixed and opened fibers and passing them through a mixing roll which further opens said fibers and then through a compression area.

11. A fiber opening and blending arrangement including opening and blending rolls, said rolls each comprise a cylinder having an axis and including a plurality of radially spaced linear rows and a plurality of teeth secured along said rows in spaced positions and extending substantially perpendicularly of said linear rows;

said teeth having a generally upstanding L-shaped body portion arranged and positioned along said linear rows to create an air current which moves along a sinusoidal path generally diagonal of said axis during rotation of said cylinders.

12. The roll of claim 11 wherein each said row includes a raised bar aligned with said axis, said teeth being connected with said raised bars.

13. A fiber opening and blending arrangement including an opening and blending roll, said roll comprising a cylinder having an axis and including a plurality of radially spaced linear rows aligned with and carrying a plurality of teeth secured along and extending in spaced positions substantially perpendicularly of said rows;

said teeth being constructed and arranged to create an air current which moves along a path diagonally of said axis during rotation of said cylinder;

wherein each said tooth comprises a body extending substantially perpendicular of said row, said body including a pair of planar sections secured along one edge forming an angle of about 60°.

14. The roll of claim 13 wherein a first of said planar sections of said teeth are arranged in perpendicular positions relative the longitudinal axis of said bars.

15. The roll of claim 13 wherein second ones of said planar sections are arranged in opposed positions on adjacent of said bars.

* * * * *